US007246384B2

(12) United States Patent
Bentz

(10) Patent No.: US 7,246,384 B2
(45) Date of Patent: Jul. 24, 2007

(54) HEADGEAR AND CHIN STRAP WITH MAGNETIC FASTENER

(76) Inventor: William George Bentz, 8106 Shannon's Alley, Laurel, MD (US) 20724

( * ) Notice: Subject to any disclaimer, the term of this patent is extended or adjusted under 35 U.S.C. 154(b) by 0 days.

(21) Appl. No.: 11/030,046

(22) Filed: Jan. 7, 2005

(65) Prior Publication Data

US 2006/0150304 A1 Jul. 13, 2006

(51) Int. Cl.
*A42B 7/00* (2006.01)
*A44B 1/04* (2006.01)

(52) U.S. Cl. ..... 2/421; 2/9; 24/303

(58) Field of Classification Search ..... 2/421, 2/417, 418, 419, 425, 9; 24/303
See application file for complete search history.

(56) References Cited

U.S. PATENT DOCUMENTS

| | | | | |
|---|---|---|---|---|
| 873,128 | A | 12/1907 | Holmes | |
| 1,712,976 | A | 5/1929 | Blair | |
| 1,923,050 | A | 8/1933 | Carr | |
| 2,867,811 | A * | 1/1959 | Jones | 2/421 |
| 3,009,225 | A | 11/1961 | Budreck | |
| 3,129,477 | A | 4/1964 | Mizuno | |
| 3,141,216 | A | 7/1964 | Brett | |
| 3,237,257 | A * | 3/1966 | Forsberg | 24/324 |
| 3,324,521 | A * | 6/1967 | Humiston | 24/303 |
| 3,372,443 | A * | 3/1968 | Daddona, Jr. | 24/303 |
| 3,589,341 | A | 6/1971 | Krebs | |
| 3,609,765 | A * | 10/1971 | Molitoris | 2/418 |
| 3,994,021 | A | 11/1976 | Villari et al. | |
| 4,021,891 | A | 5/1977 | Morita | |
| 4,051,556 | A | 10/1977 | Davenport | |
| 4,231,137 | A | 11/1980 | Fujimoto | |
| 4,265,002 | A | 5/1981 | Hosken | |
| 4,398,306 | A * | 8/1983 | Gooding | 2/421 |
| 4,453,294 | A | 6/1984 | Morita | |
| 4,455,719 | A | 6/1984 | Morita | |
| 4,480,361 | A | 11/1984 | Morita | |
| 4,646,368 | A | 3/1987 | Infusino et al. | |
| 4,700,436 | A | 10/1987 | Morita | |
| 4,741,054 | A | 5/1988 | Mattes | |
| 4,875,654 | A | 10/1989 | Chandonnet et al. | |
| 4,903,349 | A * | 2/1990 | Arai | 2/421 |
| 4,941,235 | A | 7/1990 | Aoki | |
| 4,989,299 | A | 2/1991 | Morita | |
| 4,991,270 | A | 2/1991 | Aoki | |
| 5,042,116 | A | 8/1991 | Ossiani | |
| 5,259,096 | A | 11/1993 | Grant | |
| 5,347,660 | A | 9/1994 | Zide et al. | |
| 5,432,986 | A | 7/1995 | Sexton | |
| 5,572,887 | A | 11/1996 | Geswelli | |
| 5,707,091 | A * | 1/1998 | Morita | 292/251.5 |
| 5,713,804 | A | 2/1998 | Socci et al. | |
| 5,933,926 | A * | 8/1999 | Reiter | 24/303 |

(Continued)

FOREIGN PATENT DOCUMENTS

FR 2539011 A1 * 7/1984

*Primary Examiner*—Rodney Lindsey
(74) *Attorney, Agent, or Firm*—William G. Bentz

(57) ABSTRACT

One embodiment of an apparatus includes a headgear, a chin strap and a magnetic fastener including a slide socket and a stud. The slide socket is attached to the chin strap and the stud is attached to the headgear. The slide socket is configured to be magnetically attracted to the stud to secure the chin strap to the headgear.

16 Claims, 6 Drawing Sheets

U.S. PATENT DOCUMENTS

| | | | | |
|---|---|---|---|---|
| 6,009,601 | A | 1/2000 | Kaufman | |
| 6,081,932 | A | 7/2000 | Kraemer | |
| 6,182,336 | B1 | 2/2001 | Bauer | |
| 6,324,701 | B1 | 12/2001 | Alexander | |
| 6,434,755 | B1 | 8/2002 | Halstead et al. | |
| D465,067 | S | 10/2002 | Ide et al. | |
| 6,481,024 | B1 | 11/2002 | Grant | |
| 6,557,218 | B2 | 5/2003 | Kipperman | |
| 6,564,434 | B1 | 5/2003 | Morita | |
| 6,647,597 | B2 * | 11/2003 | Reiter | 24/303 |
| 2004/0078869 | A1 | 4/2004 | Bell et al. | |
| 2005/0127659 | A1 * | 6/2005 | Hearn et al. | 280/801.1 |

* cited by examiner

HEADGEAR AND CHIN STRAP WITH MAGNETIC FASTENER

FIELD OF THE INVENTION

The present invention relates in general to headgears and/or chin straps. In particular, the present invention relates to headgears and/or chin straps with one or more magnetic fasteners.

DESCRIPTION OF BACKGROUND INFORMATION

Various activities such as, for example, contact sports and hazardous occupations, require the use of helmets to protect participants from head injuries. Conventional football helmets, for example, include a chin strap to secure a helmet to a player's head for protection. Particularly, conventional female snap fasteners on the ends of the chin strap are manually aligned and mechanically snapped to conventional male snap fasteners on the lower edges of the football helmet to secure the helmet to the player's head.

Football players often remove their chin straps between plays and/or series. The conventional snap fasteners of football helmets, however, are burdensome to use, resulting in a player struggling and/or failing to properly align and/or snap one or more conventional female snap fasteners on a chin strap with one or more conventional male snap fasteners on a helmet before a play and/or series. When the chin strap is not properly secured to the helmet, the player may not be adequately protected from head injuries.

BRIEF DESCRIPTION OF THE DRAWINGS

In the drawings, like reference numerals represent similar parts of the illustrated embodiments of the present invention throughout the several views and wherein.

DETAILED DESCRIPTION

Figure 1B:
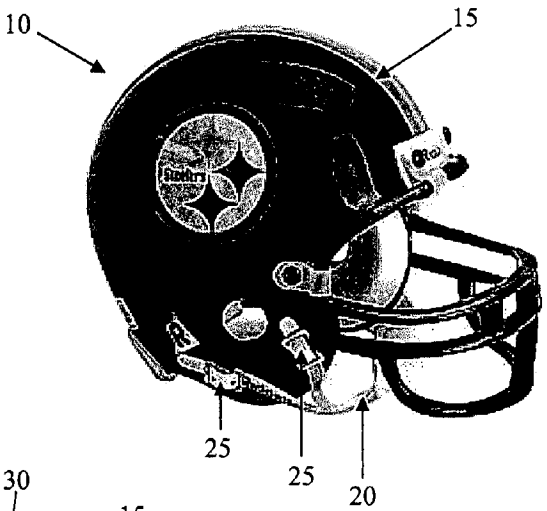
FIGS. 1A, 1B and 1C depict different embodiments of an apparatus including a headgear, a chin strap, and one or more magnetic fasteners.
Figure 1A:
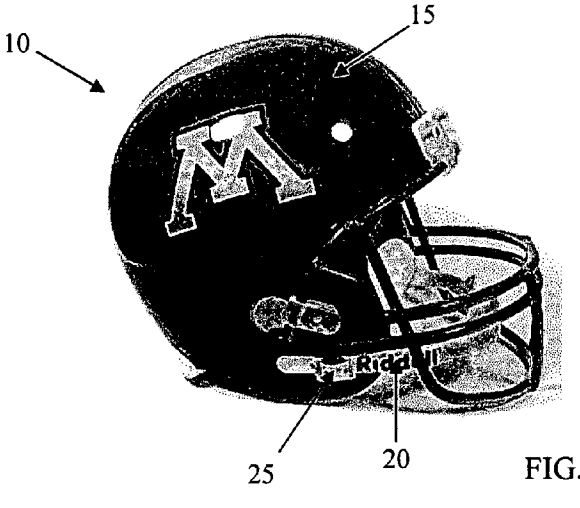
Figure 1C:
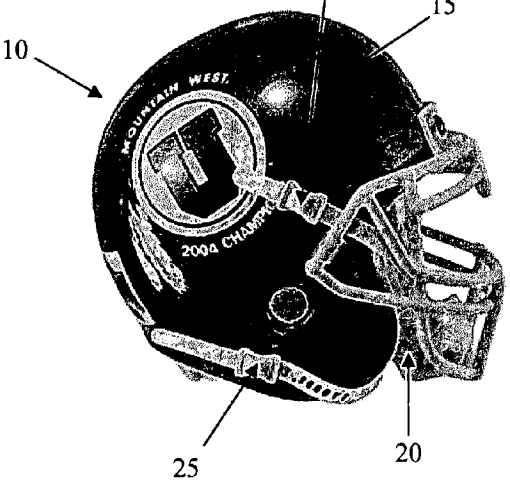
Figure 2A:
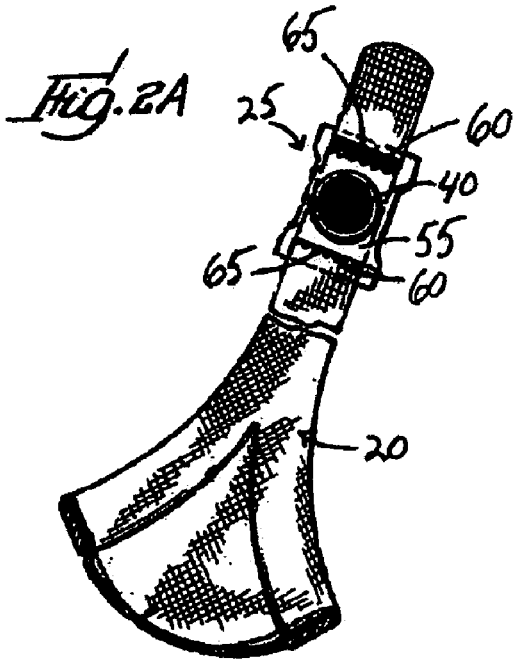
FIGS. 2A, 2B and 2C depict different views of the chin strap of FIG. 1A.
Figure 2B:
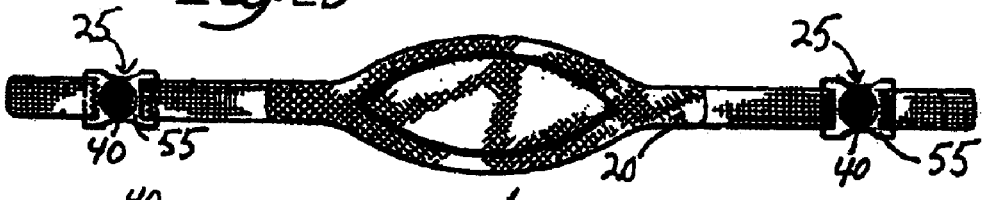
Figure 2C:
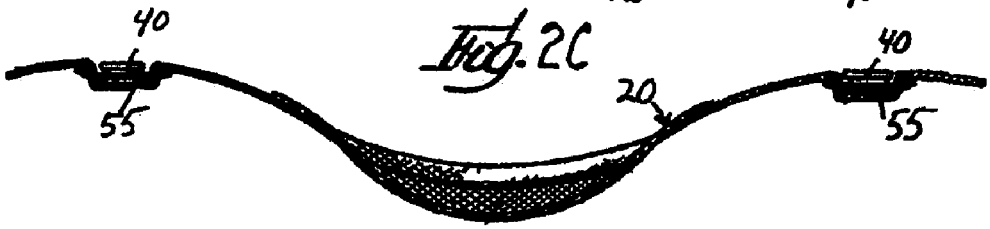
Figure 5A:
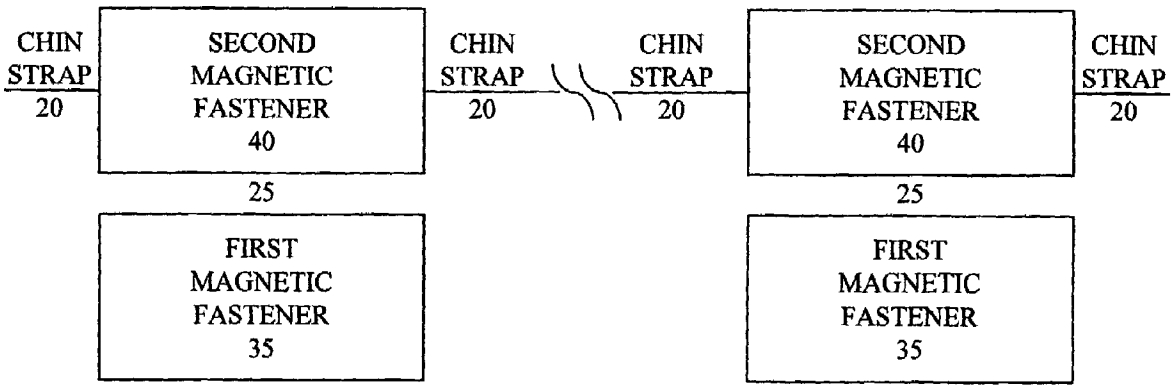
FIGS. 5A, 5B and 5C depict different embodiments of a chin strap.
Figure 5B:
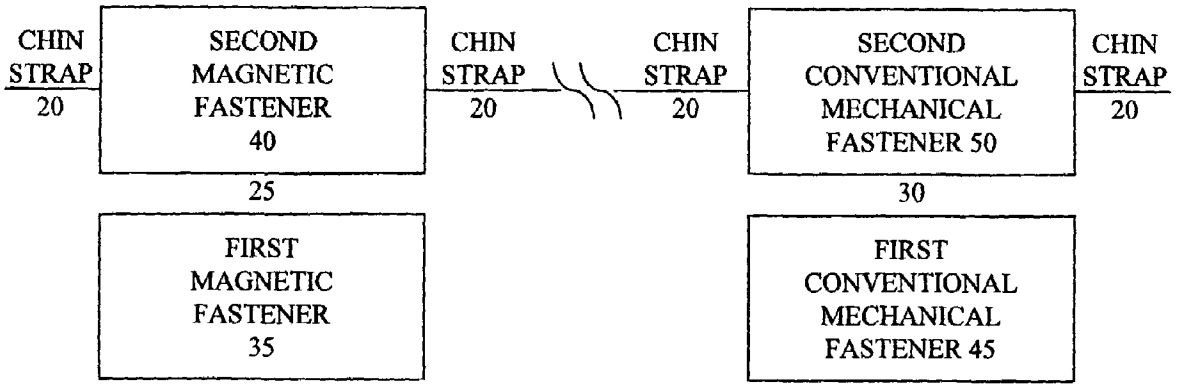
Figure 5C:
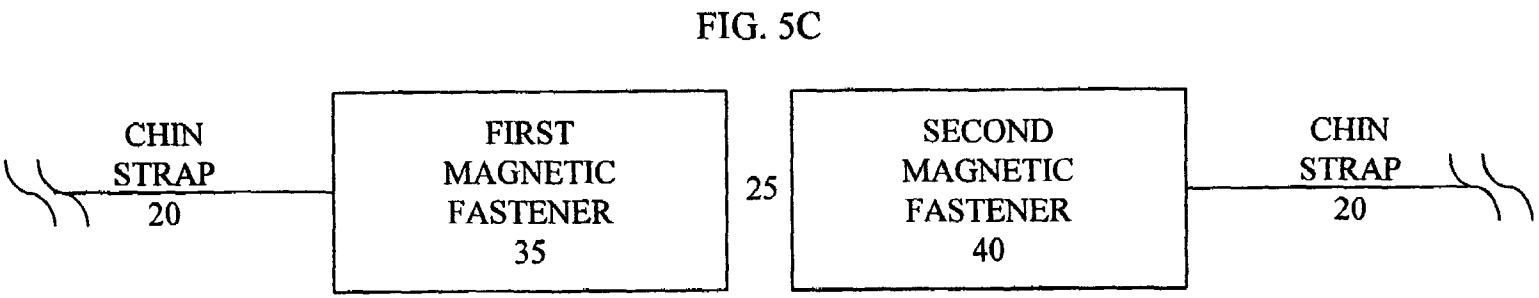

One embodiment of an apparatus 10 may include a headgear 15, a chin strap 20, one or more magnetic fasteners 25 and/or one or more conventional mechanical fasteners 30, as illustrated by FIGS. 1A, 1B and 1C and/or FIGS. 5A, 5B and 5C. The magnetic 25 and/or conventional mechanical 30 fastener(s) may be attached (e.g., adjustably, releasably and/or permanently attached) to the chin strap 20 and/or the headgear 15. The magnetic fastener(s) 25 provide a strong, reliable, easy to operate, fin and/or quick securement structure of the chin strap 20 to the headgear 15 to protect a user from head injuries.

A magnetic fastener 25 may include a first fastener 35 (e.g., a stud) and a second fastener 40 (e.g., a slide socket) configured to be magnetically attracted and/or combined to the first fastener 35, as illustrated by FIGS. 5A, 5B and 5C. The magnetic fastener 25 may also include one or more magnets that, for example, may be annular shaped. The first fastener 35 may be one of a male fastener and a female fastener, and the second fastener 40 may be the other of the male fastener and the female fastener. A projection of the male fastener may be aligned with and/or inserted into an opening of the female fastener, for example, by an operation of at least the one or more magnets. When the male and female fasteners are brought somewhat together, they snap into place even though they may not be in exact alignment. The male and female fasteners are releasably matable.

One of the first fastener 35 and the second fastener 40 may be attached to the headgear 15, and the other of the first fastener 35 and the second fastener 40 may be adjustably attached to the chin strap 20, as illustrated by FIGS. 5A and 5B.

The chin strap 20 may also include a first chin strap portion and a second chin strap portion. The first chin strap portion may be coupled to one of the first fastener 35 and the second fastener 40, and the second chin strap portion may be coupled to the other of the first fastener 35 and the second fastener 40, as illustrated by FIG. 5C.

The headgear 15 may be a protective headgear, a military headgear, an athletic headgear and/or any other type of known headgear. The headgear 15, for example, may be a football helmet, a lacrosse helmet, a batting helmet, a hockey helmet, a bicycle helmet, a racing helmet, and/or a skateboard helmet.

The chin strap 20 may be a football helmet chin strap and/or any other type of chin strap utilized with a headgear. One category of the chin strap 20 may be worn under the chin at the junction of the chin and the throat. Another category of the chin strap 20 may include a chin cup and/or intersecting straps that fit over the chin. The chin strap 20 may include any commercially available chin strap, for example, by Adams, Nokona, Rawlings, Riddell, Schutt, Wilson, etc. The chin strap 20 may be a 2-point chin strap (see, for example, FIG. 1A), a 4-point low chin strap (see, for example, FIG. 1B) and/or a 4-point high chin strap (see, for example, FIG. 1C).

The conventional mechanical fastener 30 may include any type of conventional fastener (e.g., mechanical snap fastener) that may be utilized with a chin strap and/or a headgear such as, for example, as described in U.S. Pat. Nos. 1,712,976, 2,867,811, 3,237,257, 4,051,556, 5,259,096 and/or 6,324,701, all of which are hereby incorporated by reference. The conventional mechanical fastener 30 may include a first fastener 45 and a second fastener 50 configured to be manually aligned and mechanically combined to the first fastener 45, as illustrated by FIG. 5B. The first fastener 45 may be one of a male fastener and a female fastener, and the second fastener 50 may be the other of the male fastener and the female fastener. One of the first fastener 45 and the second fastener 50 may be attached to the headgear 15, and the other of the first fastener 45 and the second fastener 50 may be adjustably attached to the chin strap 20.

The magnetic fastener 25 may include, in part or in whole, any type of known magnetic fastener such as, for example, as described in U.S. Pat. Nos. 3,009,225, 3,141,216, 3,324, 521, 3,372,443, 4,021,891, 4,265,002, 4,453,294, 4,455,719, 4,480,361, 4,700,436, 4,875,654, 4,941,235, 4,989,299, 4,991,270, 5,042,116, 5,432,986, 5,572,887, 5,933,926, 6,009,601, 6,182,336, and/or 6,564,434, all of which are hereby incorporated by reference. The magnetic fastener 25 may include a first part and a second part, each of which may contain surfaces of magnetic material. The first part, for example, may contain a magnetic material that may be attracted to a permanent magnet in the second part. The magnetic fastener 25 may also contain permanent magnets in both parts. The magnetic fastener 25 may be a magnetic snap fastener and/or a magnetic button fastener.

The magnetic fastener 25 may be attached to any type of attachment structure that may secure (e.g., slidably, adjustably, releasably and/or permanently) the magnetic fastener 25 to a chin strap and/or a headgear. The attachment structure, for example, may be, in part or in whole, as described in U.S. Pat. Nos. 1,712,976, 2,867,811, 3,237,257, 4,051,556 and/or 5,259,096. An example of the attachment structure may include a plate 55 including slots 60 with teeth 65, as illustrated by FIGS. 2A, 2B, and 2C and FIGS. 4A and 4B. A user may adjust the over-all fit of the headgear 10 and the chin strap 20, for example, by sliding the magnetic 25 and/or conventional mechanical 30 fastener(s) relative to the chin strap 20.

Figure 3A:
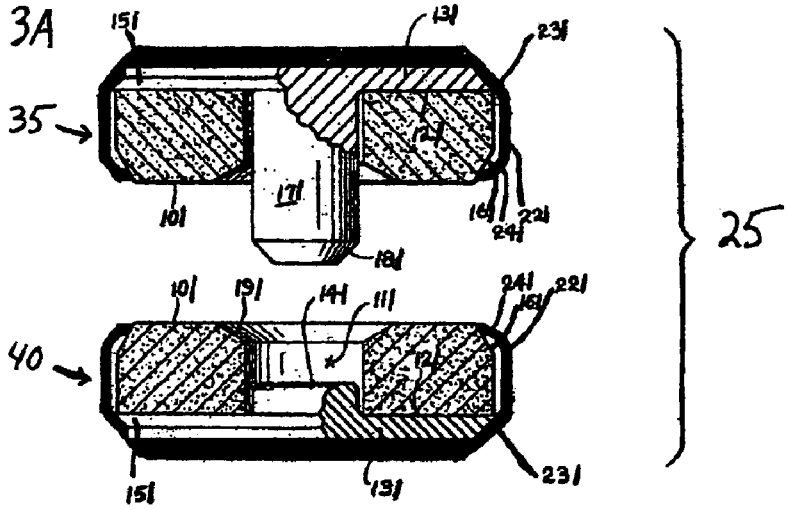
FIG. 3A depicts a cross-sectional view of one embodiment of a magnetic fastener including a male fastener and a female fastener.
Figure 3B:
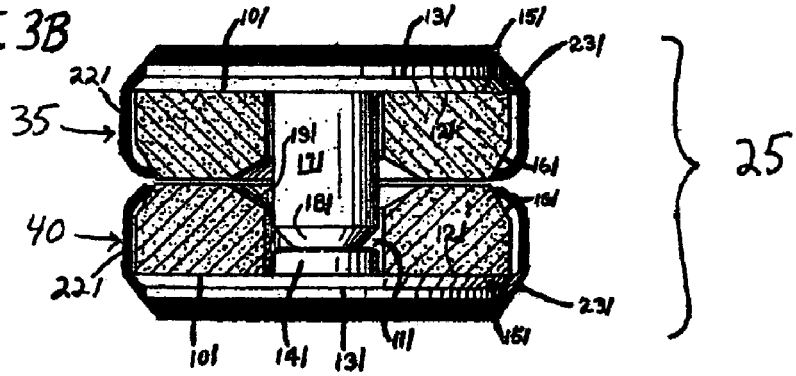
FIG. 3B depicts the magnetic fastener of FIG. 3A with the male fastener engaged to the female fastener.

FIGS. 3A and 3B illustrate one embodiment of a magnetic fastener 25 that may include a female fastener 40 and a male fastener 35. The female fastener may include a permanent magnet 101 of generally cylindrical shape and an axial hole 111. An armature 131 may be mounted to an outer surface 121 of the magnet. The armature may include a disc of iron and/or steel, and a pin 141 extending partly into the hole 111. The armature may also include a beveled surface 151, and the magnet may also include a beveled surface 161.

The male fastener 35 may be constructed generally the same as the female fastener 40, and corresponding numerals are used where applicable. A pin 171 of the male fastener may be longer than the pin 141 of the female fastener, and project through and beyond a magnet 101 of the male fastener. The pin 171 may include a tapered end 181 that cooperates with an inclined lead-in surface 191 of the magnet of the female fastener. When the male and female fasteners are brought somewhat together, they snap into place even though they may not be in exact alignment. The male and female fasteners are releasably matable. The magnet of the female fastener and the magnet of the male fastener may be of opposing polarities.

A holder shell may secure the magnet to the armature. The holder shell may include a wall 221 with an outer edge 231 bent inwardly against the beveled surface 151 of the armature 131, and an inner edge 241 turned over into engagement with the beveled surface 161 of the magnet 10.

Figure 4A:
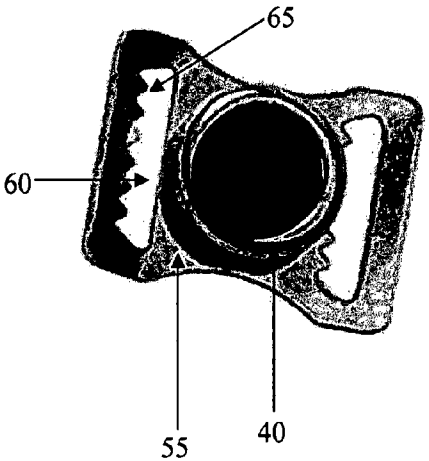
FIGS. 4A and 4B depict different embodiments of an attachment structure to secure one part of a magnetic fastener to a chin strap.
Figure 4B:
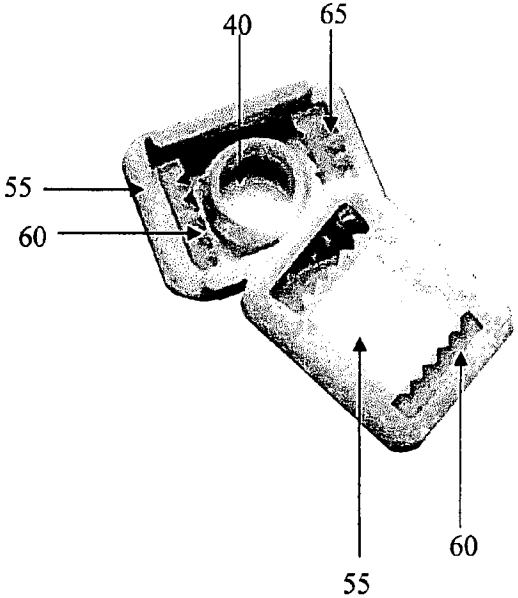
Figure 4C:
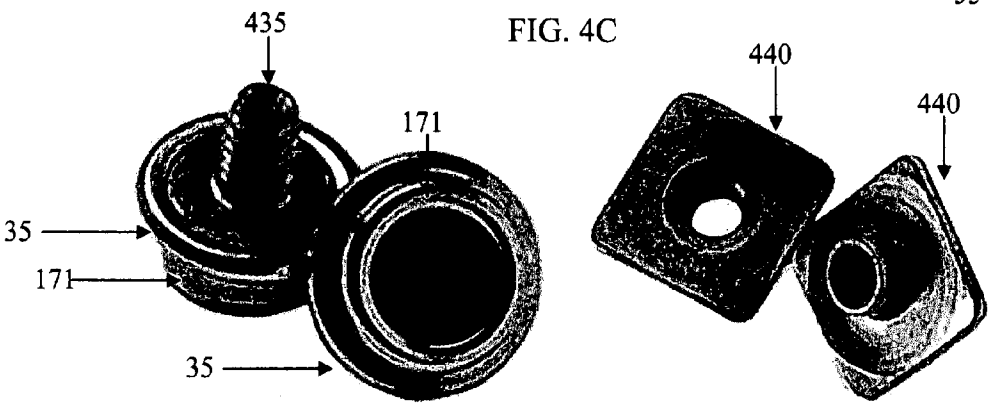
FIG. 4C depicts one embodiment of an attachment structure to secure another part of a magnetic fastener to a helmet.

The female fastener 40 may be attached to a plate 55 with slots 60 to secure the female fastener 40 to a chin strap 20, as illustrated by FIGS. 2A, 2B and 2C and FIGS. 4A and 4B. The slots 60 may be positioned near opposite ends of the plate 55. An end of the chin strap 20 may fit though the slots 60, and the slots 60 may have teeth 65 to adjustably secure the female fastener 40 to the chin strap 20. The male fastener 35 may be secured to a headgear 15 by using an attachment structure of conventional mechanical fasteners such as, for example, a threaded screw 435 and a T-nut 440, as illustrated by FIG. 4C.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and features disclosed in any fashion herein.

What is claimed is:

1. An apparatus comprising:

a headgear;

a chin strap; and a magnetic fastener including a slide socket and a stud, wherein the slide socket is attached to the chin strap and the stud is attached to the headgear, and wherein the slide socket is configured to be magnetically attracted to the stud to secure the chin strap to the headgear.

2. The apparatus of claim 1, wherein the headgear is a football helmet, and wherein the chin strap is a football chin strap.

3. The apparatus of claim 1, wherein the slide socket includes slots, and wherein the chin strap is attached, through the slots, to the slide socket.

4. The apparatus of claim 3, wherein the slots of the slide socket include teeth.

5. The apparatus of claim 1, wherein at least one of the slide socket and the stud includes a magnet.

6. The apparatus of claim 5, wherein the magnet is annular shaped.

7. The apparatus of claim 5, wherein the magnet includes an opening that receives the stud.

8. An apparatus comprising:

a chin strap including a first end and a second end;

a magnetic fastener configured to be slidably attached to the first end of the chin strap; and a mechanical fastener configured to be attached to the second end of the chin strap.

9. An apparatus comprising:

a chin strap including a first end and a second end;

a magnetic fastener configures to be attached to the first end of the chin strap; and a mechanical fastener configured to be attached to the second end of the chin strap, wherein each of the magnetic fastener and the mechanical fastener includes slots with teeth.

10. The apparatus of claim 9, wherein the magnetic fastener is a magnetic snap fastener.

11. The apparatus of claim 9, wherein the mechanical fastener is a mechanical snap fastener.

12. The apparatus of claim 9, wherein the chin strap is a football chin strap.

13. A system comprising:

a headgear;

a chin strap; and a magnetic fastener, wherein the magnetic fastener includes a first fastener and a second fastener configured to be magnetically attracted to the first fastener, wherein the chin strap includes a first chin strap portion and a second chin strap portion, wherein one end portion of the first chin strap portion is coupled to the headgear and another end portion of the first chin strap portion is coupled to the first fastener, and wherein one end portion of the second chin strap portion is coupled to the headgear and another end portion of the second chin strap portion is coupled to the second fastener, and wherein one of the fastner and the second fastener includes a projection and the other of the first fastener and the second fastener includes an opening configured to receive the projection.

14. The system of claim 13, wherein the headgear is a protective helmet.

15. An apparatus comprising:

a headgear;

a chin strap; and a magnetic fastener configured to attach the chin strap to the headgear, wherein the magnetic fastener includes a first fastener and a second fastener configured to be magnetically attracted to the first fastener, wherein the first fastener includes a projection extending beyond a frontal face of the first fastener, wherein the second fastener includes an opening configured to receive the projection of the first fastener, wherein at least one of the first fastener and the second fastener includes a permanent magnet having an annular shape, and wherein one of the first fastener and the second fastener is mounted to the headgear and the other of the first fastener and the second fastener is mounted to the chin strap.

16. The apparatus of claim 15, wherein the headgear is a football helmet, and wherein the chin strap is a football chin strap.

* * * * *